US008082854B2

(12) United States Patent
Maier

(10) Patent No.: US 8,082,854 B2
(45) Date of Patent: Dec. 27, 2011

(54) CHASSIS FOR A CABLE OR PIPELINE TROLLEY

(75) Inventor: Bernd Maier, Schliengen (DE)

(73) Assignee: Conductix-Wampfler AG, Weil Am Rhein-Markt (DE)

( * ) Notice: Subject to any disclaimer, the term of this patent is extended or adjusted under 35 U.S.C. 154(b) by 254 days.

(21) Appl. No.: 12/162,634

(22) PCT Filed: Dec. 2, 2006

(86) PCT No.: PCT/EP2006/011578
§ 371 (c)(1),
(2), (4) Date: Nov. 14, 2008

(87) PCT Pub. No.: WO2007/087854
PCT Pub. Date: Aug. 9, 2007

(65) Prior Publication Data

US 2009/0173710 A1 Jul. 9, 2009

(30) Foreign Application Priority Data

Feb. 2, 2006 (DE) ..... 10 2006 004 721

(51) Int. Cl.
*B61C 13/04* (2006.01)

(52) U.S. Cl. ..... 105/154; 105/150; 105/153; 104/95

(58) Field of Classification Search ..... 105/148, 105/150, 153, 154; 104/89, 93, 95
See application file for complete search history.

(56) References Cited

U.S. PATENT DOCUMENTS

| | | | | |
|---|---|---|---|---|
| 4,093,047 | A | 6/1978 | Wampfler | |
| 4,172,423 | A * | 10/1979 | Monne | 104/94 |
| 5,213,045 | A | 5/1993 | Gersemsky | |
| 5,711,228 | A * | 1/1998 | Itzin et al. | 105/154 |
| 6,164,210 | A * | 12/2000 | Coslovi et al. | 105/396 |
| 2009/0301341 | A1 * | 12/2009 | Maier | 104/89 |

FOREIGN PATENT DOCUMENTS

DE PS 247498 5/1912

(Continued)

OTHER PUBLICATIONS

English translation of International Preliminary Report on Patentability published Oct. 20, 2008 for PCT/EP2006/011578 filed Dec. 2, 2006.

(Continued)

*Primary Examiner* — Joe Morano, IV
*Assistant Examiner* — Zachary Kuhfuss
(74) *Attorney, Agent, or Firm* — Martin Fleit; Paul D. Bianco; Fleit Gibbons Gutman Bongini & Bianco PL

(57) ABSTRACT

The invention relates to a chassis (1) for a cable or pipeline trolley (2), for traveling along a carrier rail, the chassis including at least one pair of carrier rollers (3) having a horizontal axis of rotation and at least one pair of guide rollers (4) having a vertical axis of rotation. The disadvantage of known chassis of this type is that they jolt at uneven sections of the carrier rail and a significant supply of replacement parts is required for repairs. The aim of the invention is to develop a chassis with improved driving characteristics, whilst at the same time reducing production and inventory costs. To achieve this, the carrier rollers (3) and guide rollers (4) are essentially arranged symmetrically to a vertical axis.

12 Claims, 2 Drawing Sheets

FOREIGN PATENT DOCUMENTS

| | | | |
|---|---|---|---|
| DE | 1767562 | | 5/1968 |
| DE | 2628112 | | 1/1978 |
| DE | 3315862 | | 10/1994 |
| DE | 4436520 | | 9/1995 |
| DE | 4436519 | | 4/1996 |
| DE | 10261843 | A1 | 12/2002 |
| EP | 0505016 | | 9/1992 |
| EP | 2103562 | A1 * | 2/2009 |
| GB | 1234226 | | 5/1967 |

OTHER PUBLICATIONS

International Preliminary Report on Patentability published Aug. 2, 2008 for PCT/EP2006/011578 filed Dec. 2, 2006.

International Search Report published Aug. 9, 2007 for PCT/EP2006/011578 filed Dec. 2, 2006.

Written Opinion of the International Search Authority, published Aug. 2, 2008 for PCT/EP2006/011578 filed Dec. 2, 2006.

Corrected International Preliminary Report on Patentability mailed Dec. 1, 2008 for PCT/EP2006/011578 filed Dec. 2, 2006.

International Preliminary Report on Patentability (corrected version), published Oct. 13, 2009 for PCT/EP2006/011578, filed Dec. 2, 2006.

* cited by examiner

CHASSIS FOR A CABLE OR PIPELINE TROLLEY

FIELD OF THE INVENTION

The invention relates to a chassis for a cable or pipeline trolley for movement along a carrier rail, as well as to a cable or pipeline trolley equipped with such a chassis.

BACKGROUND OF THE INVENTION

A cable or pipeline trolley that contains such a chassis is the subject matter of DE 44 36 520 C1 and DE 44 36 519 C2 as well as DE 26 28 112 C2. Corresponding cable or pipeline trolleys are found, for instance, in line-laying devices or for crane booms, that is, for all applications in which power-carrying or gas-carrying lines must be led along a rail to a movable load, e.g., the traveler of a crane. The above-mentioned publications describe both passive cable or pipeline trolleys, i.e., those without power of their own, and active cable or pipeline trolleys, i.e., those with their own power.

Cable or pipeline trolleys consist as a rule of three main elements, namely one or more chassis, the middle part or middle plat; and the actual suspension device for the lines to be transported. As a rule, the chassis are suspended from double T-shaped carrier rails, also referred to as I-beams. On the underside of the chassis, the carrier plate is mounted, on which in turn the actual suspension device for the lines to be transported is mounted. As a rule, a cable or pipeline trolley is equipped with two chassis, or with one chassis consisting of four side panels, each having a pair of carrier rollers that move on the carrier rail opposite one another with a substantially horizontal axis of rotation, and that absorb the weight forces. Every chassis further comprises a pair of opposing guide rollers with a substantially vertical axis of rotation, which are dimensioned thinner than the carrier rollers since they need not absorb the weight of the cable or pipeline trolley, but serve only for guidance along the vertical central leg of the I-shaped carrier rail. In all known chassis for cable or pipeline trolleys, one carrier roller and one guide roller is arranged on each carrier plate, and the two carrier plates are bolted together. For reasons of symmetry, each carrier plate must be constructed mirror-symmetrically with respect to the other carrier plate, so that the two different carrier plates, namely a left one and a right one, must be manufactured and kept in stock.

Chassis for cable or pipeline trolleys known from prior art have the further disadvantage that they jolt in case of uneven spots in the carrier rail because both carrier rollers pass the uneven spot at the same time. Moreover, the guidance of these known chassis on the carrier rail is not optimal since the guide rollers must be arranged offset to the carrier rollers.

Therefore the problem exists of refining a chassis for a cable or pipeline trolley, as well as a cable or pipeline trolley equipped with such a chassis, in such a manner that better travel properties are achieved, wherein a cost reduction for manufacturing and storage should likewise take place.

SUMMARY OF THE INVENTION

This problem is solved by the characterizing features of the chassis described herein. Advantageous configurations can be deduced from the drawings and description herein. A cable or pipeline trolley equipped with this chassis is also described herein.

BRIEF DESCRIPTION OF THE DRAWINGS

An embodiment of the invention will be described in detail below with reference to the accompanying drawings. They show.

DETAILED DESCRIPTION OF THE INVENTION

Figure 2:
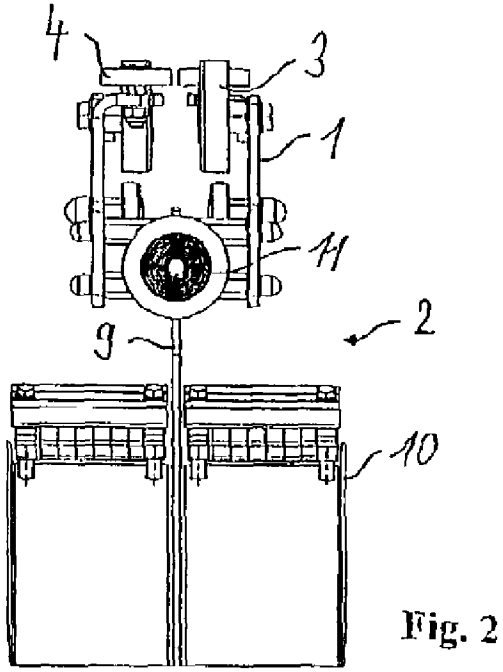
FIG. 2: a front view of the cable or pipeline trolley represented in FIG. 1.
Figure 1:
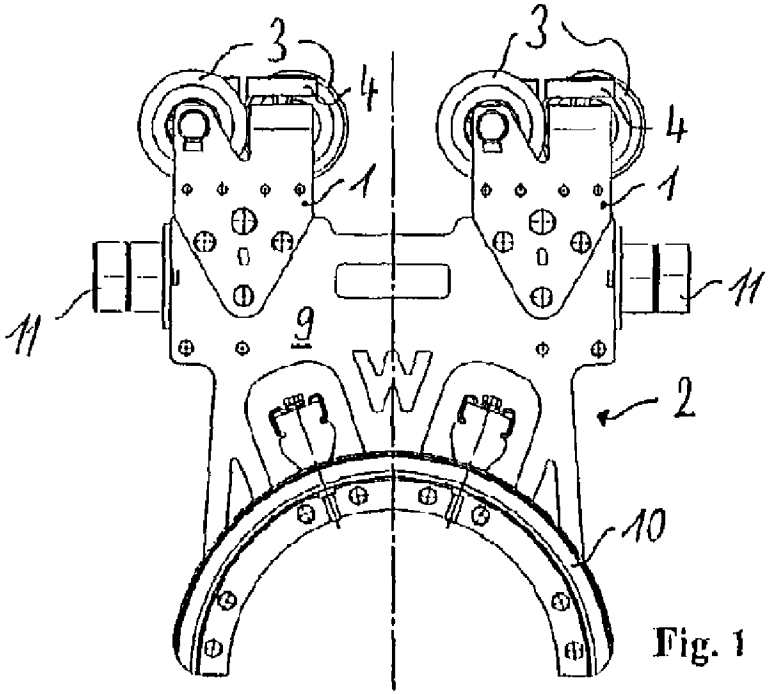
FIG. 1: a side view of a cable or pipeline trolley with two chassis according to the invention.
Figure 3:
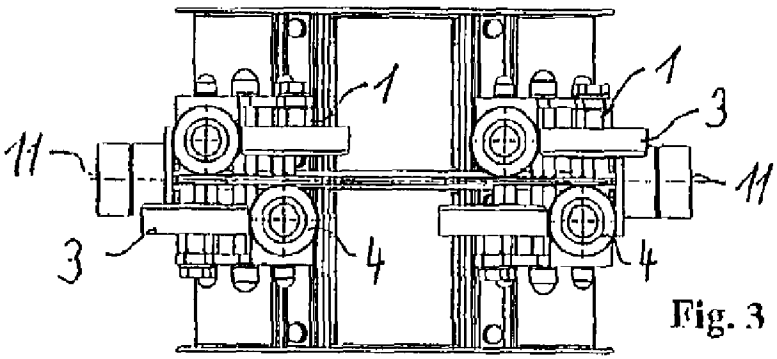
FIG. 3: a top view of the cable or pipeline trolley represented in FIGS. 1 and 2.

Cable or pipeline trolley (2) represented in FIGS. 1-3 consists of a middle part or middle plate (9) that connects two chassis (1) to a carrier device (10) for the electricity and/or gas lines (not shown) to be transported. At the opposite ends in the direction of travel, center plate (9) comprises cell bumpers (11), which have a damping effect in case of collision of adjacent cable or pipeline trolleys and form a collision bumper. On its upper side, center plate (9) in the illustrated embodiment (2) has chassis (1) arranged one after the other in the direction of travel. These chassis (1) are constructed identically and are shown in detail in FIGS. 4-6.

Figure 5:
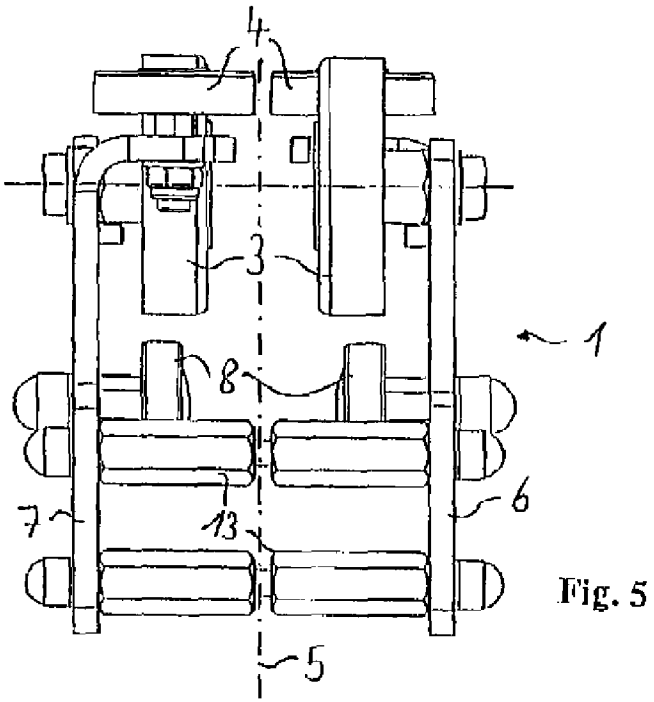
FIG. 5: a representation of the chassis according to FIG. 4 from the front.

Each chassis (1) has two opposing carrier plates (6) and (7) made of steel or a suitable plastic that, as viewed from above, are formed tapering down towards the bottom and have several connecting boreholes (12) in their lower areas, through which treaded fasteners (13) are passed in order to connect the two carrier plates (6) and (7) to one another, as can be seen most clearly from FIG. 5. At their upper area, the two carrier plates (6) and (7) each bear a carrier roller (3) with a substantially horizontal axis of rotation and a guide roller (4) with a substantially vertical axis of rotation.

However, the two carrier rollers (3) are not arranged opposing one another in the bolted-together state of the two carrier plates (6) and (7), nor are guide rollers (4). Instead left carrier roller (3) opposes right guide roller (4) and right carrier roller (3) opposes left guide roller (4), as is visible in FIGS. 4-6, particularly in FIG. 6. In contrast to the chassis known from prior art, the arrangement of carrier and guide rollers (3) and (4) is thus not mirror-symmetrical to a plane along the carrier rail (not shown), but rather is axially symmetrical to a vertical axis (5) situated roughly in the center of chassis (1).

Figure 4:
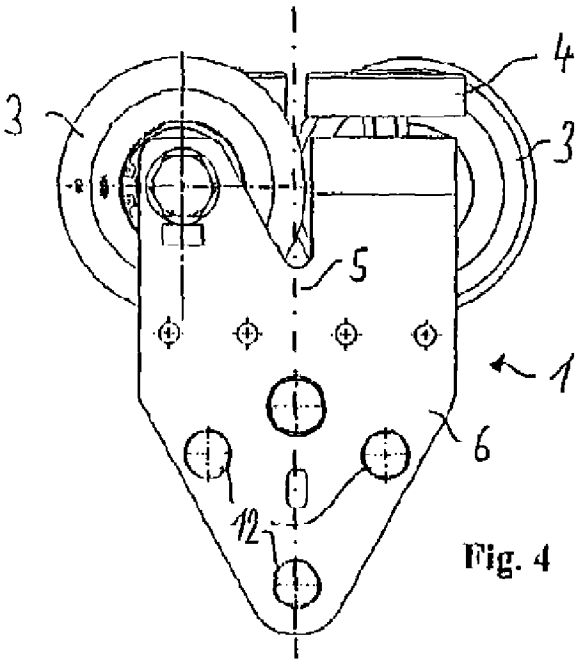
FIG. 4: a chassis as used in the cable or pipeline trolley represented in FIGS. 1-3.
Figure 6:
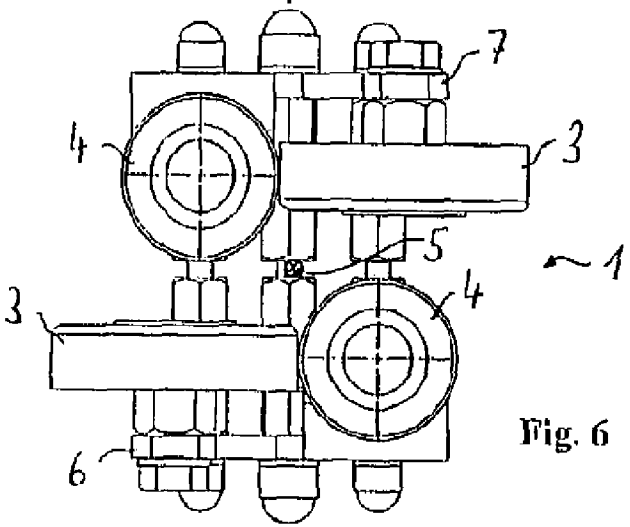
FIG. 6: a representation of the chassis according to FIGS. 4 and 5 from above.

As is visible in FIGS. 4-6, the two carrier plates (6) and (7) can be constructed identically to one another. In other words, there is no longer a difference between left carrier plate (6) and right carrier plate (7); these are completely interchangeable individual parts, which also need only be kept in storage as one part.

In the example represented, chassis (1) has additional support rollers (8), or backing rollers, which have a substantially horizontal axis of rotation and are arranged on carrier plates (6) and (7). These serve to secure chassis (1) against lifting off of the carrier rail.

The chassis of the invention also has considerable advantages in operation with respect to chassis known from prior art. Since the carrier rollers (3) are not arranged facing one another, but rather are offset in the direction of travel, uneven spots of the carrier profile are much more easily absorbed and compensated, because generally one carrier roller (3) always reliably remains on the carrier profile. There also results an improved guidance of chassis (1) and thus of cable or pipeline trolley (2) by the direct opposition of carrier roller (3) and guide roller (4). There also results an improved flow of force between guide rollers (4) and center plate (9) due to a smaller lateral offset of the force introduction into the center plate. Finally, the weight reduction from a corresponding reduction of parts, and thus lower manufacturing costs, as well as lower running noise, can be mentioned as advantages. Furthermore, assembly and disassembly are simplified because of the lower number of required parts, and errors in assembly are avoided since the two carrier plates (6) and (7) are constructed identically to one another.

The invention claimed is:

1. A chassis (1) for a cable or pipeline trolley (2) for movement along a carrier rail in a direction of movement, the chassis (1) having a central vertical axis (5) and comprising:

at least one pair of carrier rollers (3), each carrier roller (3) having a separate horizontal axis of rotation; and at least one pair of guide rollers (4) having a vertical axis of rotation perpendicular to each horizontal axis of rotation, the carrier rollers (3) and the guide rollers (4) arranged in an arrangement such that one of the pair of carrier rollers (3) is located in front of with respect to the direction of movement one of the pair of guide rollers (4) on a first side of the carrier rail and the other carrier roller (3) is located behind with respect to the direction of movement the other guide roller (4) on a second side of the carrier rail, the carrier roller (3) on the second side of the carrier rail opposing the guide roller (4) on the first side of the carrier rail and the carrier roller (3) on the first side of the carrier rail opposing the guide roller (4) on the second side of the carrier rail, wherein the arrangement of the carrier rollers (3) and the guide rollers (4) is axially symmetrical to the vertical axis (5) of the chassis (1) and wherein no two carrier rollers (3) have the same horizontal axis of rotation.

2. The chassis (1) according to claim 1, further comprising two carrier plates (6, 7) connected to one another and constructed identically to one another, wherein each of the carrier plates (6, 7) bears one of the pair of carrier rollers (3) and one of the pair of guide rollers (4).

3. The chassis (1) according to claim 1, further comprising a pair of support rollers (8) having the same horizontal axis of rotation as the carrier rollers (3) arranged underneath the carrier rail.

4. The chassis (1) according to claim 2, further comprising a pair of support rollers (8) having the same horizontal axis of rotation as the carrier rollers (3) arranged underneath the carrier rail.

5. A cable or pipeline trolley (2) for movement along a carrier rail comprising at least one chassis (1) according to claim 1.

6. A cable or pipeline trolley (2) for movement along a carrier rail comprising at least one chassis (1) according to claim 2.

7. A cable or pipeline trolley (2) for movement along a carrier rail comprising at least one chassis (1) according to claim 3.

8. A cable or pipeline trolley (2) for movement along a carrier rail comprising at least one chassis (1) according to claim 4.

9. A chassis (1) for a cable or pipeline trolley (2) for movement along a carrier rail in a direction of movement, the chassis (1) consisting of:

at least one pair of carrier rollers (3) having a horizontal axis of rotation; and at least one pair of guide rollers (4) having a vertical axis of rotation perpendicular to the horizontal axis of rotation, the carrier rollers (3) and the guide rollers (4) arranged in an arrangement such that one of the pair of carrier rollers (3) is located in front of with respect to the direction of movement one of the pair of guide rollers (4) on a first side of the carrier rail and the other carrier roller (3) is located behind with respect to the direction of movement the other guide roller (4) on a second side of the carrier rail, the carrier roller (3) on the second side of the carrier rail opposing the guide roller (4) on the first side of the carrier rail and the carrier roller (3) on the first side of the carrier rail opposing the guide roller (4) on the second side of the carrier rail, wherein the arrangement of the carrier rollers (3) and the guide rollers (4) is axially symmetrical to a vertical axis (5) of the chassis (1) and wherein no two carrier rollers (3) have the same horizontal axis of rotation.

10. The chassis (1) according to claim 9, further comprising two carrier plates (6, 7) connected to one another and constructed identically to one another, wherein each of the carrier plates (6, 7) bears one of the pair of carrier rollers (3) and one of the pair of guide rollers (4).

11. The chassis (1) according to claim 9, further comprising a pair of support rollers (8) having the same horizontal axis of rotation as the carrier rollers (3) arranged underneath the carrier rail.

12. A cable or pipeline trolley (2) for movement along a carrier rail comprising at least one chassis (1) according to claim 9.

* * * * *